US012089628B2

(12) United States Patent
Conner et al.

(10) Patent No.: US 12,089,628 B2
(45) **Date of Patent: *Sep. 17, 2024**

(54) HEAT GENERATION APPARATUS FOR AN AEROSOL-GENERATION SYSTEM OF A SMOKING ARTICLE, AND ASSOCIATED SMOKING ARTICLE

(71) Applicant: R.J. Reynolds Tobacco Company, Winston-Salem, NC (US)

(72) Inventors: Billy Tyrone Conner, Clemmons, NC (US); Timothy Franklin Tilley, Pinnacle, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/330,762

(22) Filed: Jun. 7, 2023

(65) Prior Publication Data

US 2023/0397655 A1 Dec. 14, 2023

Related U.S. Application Data

(63) Continuation of application No. 17/745,507, filed on May 16, 2022, now Pat. No. 11,707,083, which is a continuation of application No. 16/406,706, filed on May 8, 2019, now Pat. No. 11,375,745, which is a continuation of application No. 15/723,857, filed on Oct. 3, 2017, now Pat. No. 10,314,330, which is a continuation of application No. 14/036,536, filed on Sep. 25, 2013, now Pat. No. 9,788,571.

(51) Int. Cl.
*A24D 1/22* (2020.01)

(52) U.S. Cl.
CPC ..... *A24D 1/22* (2020.01)

(58) Field of Classification Search
CPC ..... A24D 1/22
See application file for complete search history.

(56) References Cited

U.S. PATENT DOCUMENTS

| | | | |
|---|---|---|---|
| 2,445,476 | A | 7/1948 | Folkman |
| 3,308,600 | A | 3/1967 | Erdmann et al. |
| 4,219,031 | A | 8/1980 | Rainer et al. |
| 4,280,187 | A | 7/1981 | Reuland et al. |
| 4,281,670 | A | 8/1981 | Heitmann et al. |
| 4,714,082 | A | 12/1987 | Banerjee et al. |
| 4,756,318 | A | 7/1988 | Clearman et al. |
| 4,793,365 | A | 12/1988 | Sensabaugh, Jr. et al. |
| 4,807,809 | A | 2/1989 | Pryor et al. |
| 4,819,665 | A | 4/1989 | Roberts et al. |
| 4,850,301 | A | 7/1989 | Greene, Jr. et al. |
| 4,881,556 | A | 11/1989 | Clearman et al. |
| 4,893,637 | A | 1/1990 | Hancock et al. |
| 4,893,639 | A | 1/1990 | White |
| 4,920,990 | A | 5/1990 | Lawrence et al. |
| 4,924,886 | A | 5/1990 | Litzinger |
| 4,938,238 | A | 7/1990 | Barnes et al. |
| 4,966,171 | A | 10/1990 | Serrano et al. |
| 4,981,522 | A | 1/1991 | Nichols et al. |
| 4,989,619 | A | 2/1991 | Clearman et al. |
| 5,007,440 | A | 4/1991 | Robinson et al. |
| 5,025,814 | A | 5/1991 | Raker |
| 5,020,548 | A | 6/1991 | Farrier et al. |
| 5,027,836 | A | 7/1991 | Shannon et al. |
| 5,027,837 | A | 7/1991 | Clearman et al. |
| 5,060,673 | A | 10/1991 | Lehman |
| 5,065,776 | A | 11/1991 | Lawson et al. |
| 5,067,499 | A | 11/1991 | Banerjee et al. |
| 5,076,297 | A | 12/1991 | Farrier et al. |
| 5,099,861 | A | 3/1992 | Clearman et al. |
| 5,101,839 | A | 4/1992 | Jakob et al. |
| 5,105,831 | A | 4/1992 | Banerjee et al. |
| 5,105,836 | A | 4/1992 | Gentry et al. |
| 5,105,838 | A | 4/1992 | White et al. |
| 5,109,122 | A | 4/1992 | Takeuchi et al. |
| 5,129,409 | A | 7/1992 | White et al. |
| 5,148,821 | A | 9/1992 | Best et al. |
| 5,156,170 | A | 10/1992 | Clearman et al. |
| 5,159,942 | A | 11/1992 | Brinkley et al. |
| 5,178,167 | A | 1/1993 | Riggs et al. |
| 5,183,062 | A | 2/1993 | Clearman et al. |
| 5,203,355 | A | 4/1993 | Clearman et al. |
| 5,211,684 | A | 5/1993 | Shannon et al. |
| 5,240,012 | A | 8/1993 | Ehrman et al. |
| 5,247,947 | A | 9/1993 | Clearman et al. |
| 5,271,419 | A | 12/1993 | Arzonico et al. |
| 5,303,720 | A | 4/1994 | Banerjee et al. |
| 5,327,917 | A | 7/1994 | Lekwauwa et al. |
| 5,345,951 | A | 9/1994 | Serrano et al. |
| 5,345,955 | A | 9/1994 | Clearman et al. |

(Continued)

FOREIGN PATENT DOCUMENTS

| | | |
|---|---|---|
| EP | 1 808 087 | 7/2007 |
| EP | 2 550 879 | 1/2013 |

(Continued)

*Primary Examiner* — Cynthia Szewczyk
(74) *Attorney, Agent, or Firm* — Womble Bond Dickinson (US) LLP

(57) ABSTRACT

A smoking article is provided, having opposed lighting and mouth ends, and including a mouth end portion at the mouth end. A tobacco portion is between the lighting end and the mouth end portion. An aerosol-generation system is between the lighting end and the tobacco portion. The aerosol-generation system includes a heat generation portion, comprising an elongate fluted member actuated by ignition of the lighting end. The fluted member defines grooves extending longitudinally between opposed first and second ends, with the first end being at the lighting end and the grooves being equidistantly spaced apart about the fluted member. Each groove has a maximum depth. The depth maxima of the grooves define a circle having a radius. The maximum depth of each groove is no more than the radius of the circle. A heat generation apparatus for an aerosol-generation system of a smoking article is also provided.

10 Claims, 6 Drawing Sheets

(56) References Cited

U.S. PATENT DOCUMENTS

| | | | |
|---|---|---|---|
| 5,396,911 | A | 3/1995 | Casey, III et al. |
| 5,461,879 | A | 10/1995 | Bolton et al. |
| 5,469,871 | A | 11/1995 | Barnes et al. |
| 5,533,530 | A | 7/1996 | Young et al. |
| 5,546,965 | A | 8/1996 | White |
| 5,551,451 | A | 9/1996 | Riggs et al. |
| 5,560,376 | A | 10/1996 | Meiring et al. |
| 5,588,446 | A | 12/1996 | Clearman |
| 5,598,868 | A | 2/1997 | Jakob et al. |
| 5,706,834 | A | 1/1998 | Meiring et al. |
| 5,715,844 | A | 2/1998 | Young et al. |
| 5,724,997 | A | 3/1998 | Smith et al. |
| 5,727,571 | A | 3/1998 | Meiring et al. |
| 5,902,431 | A | 5/1999 | Wilkinson et al. |
| 5,944,025 | A | 8/1999 | Cook et al. |
| 6,229,115 | B1 | 5/2001 | Voss et al. |
| 6,378,528 | B1 | 4/2002 | Beeson et al. |
| 6,849,085 | B2 | 2/2005 | Marton |
| 7,296,578 | B2 | 11/2007 | Read, Jr. |
| 7,434,585 | B2 | 10/2008 | Holmes |
| 7,479,098 | B2 | 1/2009 | Thomas et al. |
| 7,503,330 | B2 | 3/2009 | Borschke et al. |
| 7,647,932 | B2 | 1/2010 | Cantrell et al. |
| 7,753,056 | B2 | 7/2010 | Borschke et al. |
| 7,789,089 | B2 | 9/2010 | Dube et al. |
| 7,793,665 | B2 | 9/2010 | Dube et al. |
| 7,836,897 | B2 | 11/2010 | Borschke et al. |
| 8,119,555 | B2 | 2/2012 | Banerjee et al. |
| 8,186,359 | B2 | 5/2012 | Ademe et al. |
| 8,424,538 | B2 | 4/2013 | Thomas et al. |
| 8,464,726 | B2 | 6/2013 | Sebastian et al. |
| 8,469,035 | B2 | 6/2013 | Banerjee et al. |
| 8,616,217 | B2 | 12/2013 | Tsurizumi et al. |
| 8,617,263 | B2 | 12/2013 | Banerjee et al. |
| 8,678,013 | B2 | 3/2014 | Crooks et al. |
| 8,839,799 | B2 | 9/2014 | Conner et al. |
| 8,915,255 | B2 | 12/2014 | Poget et al. |
| 2005/0066896 | A1 | 3/2005 | Nestor et al. |
| 2005/0274390 | A1 | 12/2005 | Banerjee et al. |
| 2006/0169295 | A1 | 8/2006 | Draghetti |
| 2007/0023056 | A1 | 2/2007 | Cantrell et al. |
| 2007/0193593 | A1 | 8/2007 | Baba et al. |
| 2007/0215167 | A1 | 9/2007 | Llewellyn Crooks et al. |
| 2007/0215168 | A1 | 9/2007 | Banerjee et al. |
| 2009/0044818 | A1 | 2/2009 | Takeuchi et al. |
| 2010/0108081 | A1 | 5/2010 | Blevins Joyce et al. |
| 2010/0108084 | A1 | 5/2010 | Norman et al. |
| 2010/0186757 | A1 | 7/2010 | Crooks et al. |
| 2011/0271971 | A1 | 11/2011 | Tyrone et al. |
| 2012/0042885 | A1 | 2/2012 | Stone et al. |
| 2012/0067360 | A1 | 3/2012 | Conner et al. |
| 2013/0019888 | A1 | 1/2013 | Tsuruizumi et al. |
| 2013/0133675 | A1 | 5/2013 | Shinozaki et al. |
| 2013/0146075 | A1 | 6/2013 | Poget et al. |
| 2013/0167849 | A1 | 7/2013 | Ademe et al. |
| 2013/0192619 | A1 | 8/2013 | Tucker et al. |
| 2013/0233329 | A1 | 9/2013 | Sebastian et al. |
| 2013/0239980 | A1 | 9/2013 | Kaljura et al. |
| 2013/0269720 | A1 | 10/2013 | Stone et al. |
| 2014/0261470 | A1 | 9/2014 | Amiss et al. |
| 2015/0083150 | A1 | 3/2015 | Conner et al. |
| 2015/0157052 | A1 | 6/2015 | Ademe et al. |
| 2017/0000188 | A1 | 1/2017 | Nordskog et al. |

FOREIGN PATENT DOCUMENTS

| | | | |
|---|---|---|---|
| WO | WO 98/57556 | A1 | 12/1998 |
| WO | WO 2011/139730 | | 11/2011 |
| WO | WO 2012/016407 | | 2/2012 |
| WO | WO 2012/164077 | A1 | 12/2012 |
| WO | WO 2013/098380 | | 7/2013 |
| WO | WO 2013/098405 | | 7/2013 |
| WO | WO 2013/098410 | | 7/2013 |
| WO | WO 2013/104914 | | 7/2013 |
| WO | WO 2013/120849 | | 8/2013 |
| WO | WO 2013/120854 | | 8/2013 |
| WO | WO 2013/160112 | A2 | 10/2013 |
| WO | WO 2013/162028 | A1 | 10/2013 |

FIG. 10
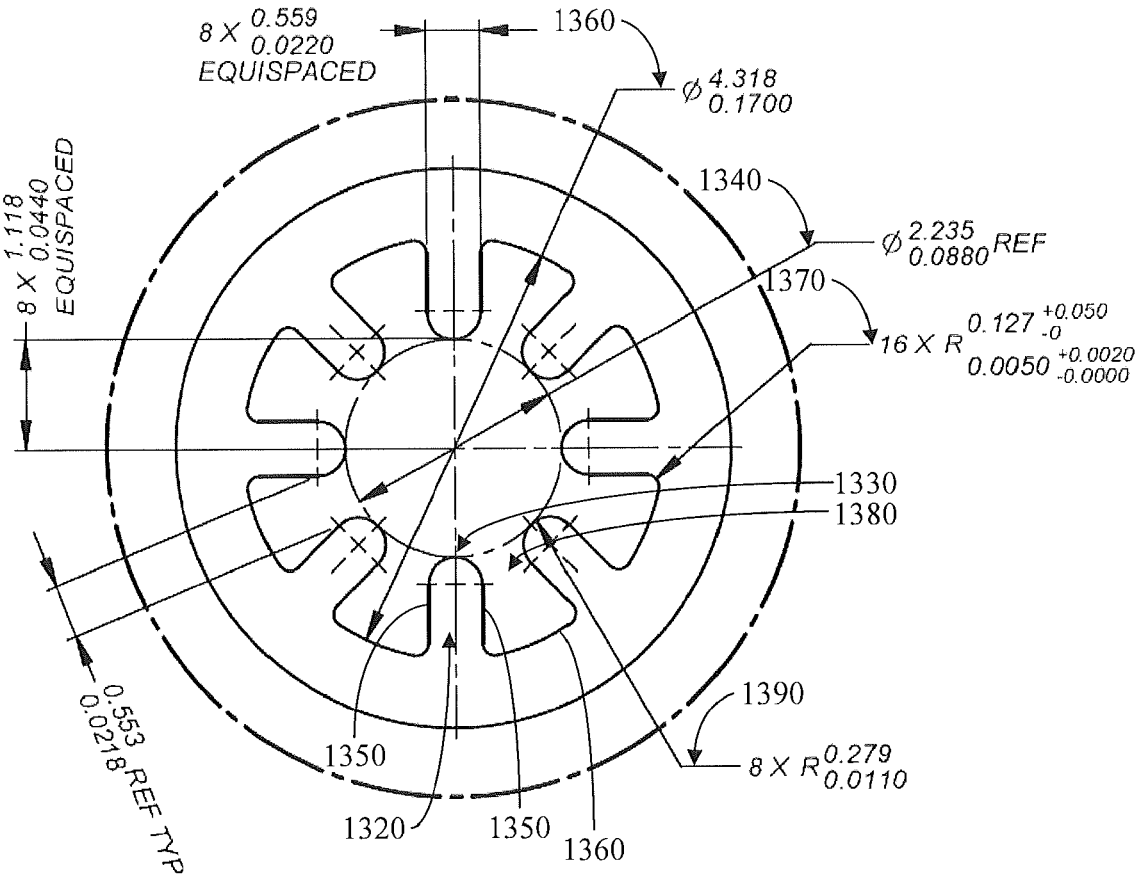
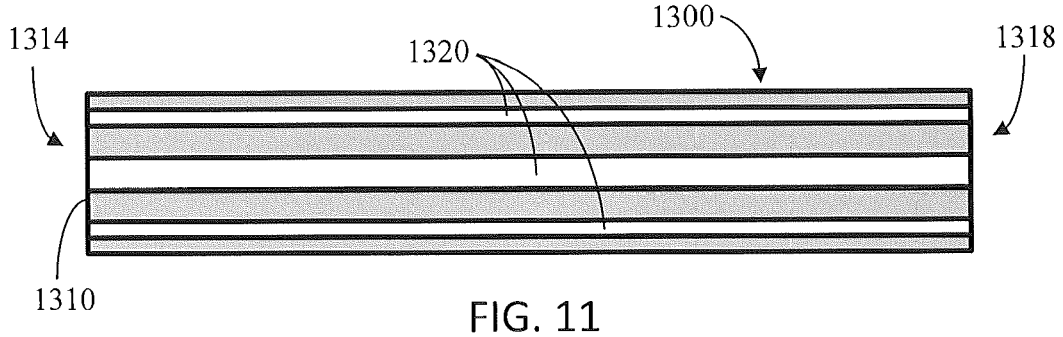
FIG. 11

HEAT GENERATION APPARATUS FOR AN AEROSOL-GENERATION SYSTEM OF A SMOKING ARTICLE, AND ASSOCIATED SMOKING ARTICLE

CROSS-REFERENCE TO RELATED APPLICATIONS

This application is a continuation of U.S. patent application Ser. No. 17/745,507, filed May 16, 2022, which is a continuation of U.S. patent application Ser. No. 16/406,706, filed May 8, 2019, which is a continuation of U.S. patent application Ser. No. 15/723,857, filed Oct. 3, 2017 and which issued as U.S. Pat. No. 10,314,330 on Jun. 11, 2019, which is a continuation of U.S. patent application Ser. No. 14/036,536, filed Sep. 25, 2013 and which issued as U.S. Pat. No. 9,788,571 on Oct. 17, 2017, each of these applications being hereby incorporated by reference in its entirety in this application.

BACKGROUND OF THE DISCLOSURE

Field of the Disclosure

The present disclosure relates to products made or derived from tobacco, or that otherwise incorporate tobacco, and are intended for human consumption and, more particularly, to components and configurations of segmented-type smoking articles.

Disclosure of Related Art

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999); which is incorporated herein by reference. A traditional type of cigarettes is employed by a smoker by lighting one end thereof and burning the tobacco rod. The smoker then receives mainstream smoke into his/her mouth by drawing on the opposite end (e.g., the filter end or mouth end) of the cigarette. Through the years, efforts have been made to improve upon the components, construction and performance of smoking articles. See, for example, the background art discussed in U.S. Pat. Nos. 7,503,330 and 7,753,056, both to Borschke et al.; which are incorporated herein by reference.

Certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette recently has been marketed in Japan by Japan Tobacco Inc. under the brand name "Steam Hot One." Furthermore, various types of smoking products incorporating carbonaceous fuel elements for heat generation and aerosol formation recently have been set forth in the patent literature. See, for example, the types of smoking products proposed in U.S. Pat. No. 7,836,897 to Borschke et al.; U.S. Pat. No. 8,469,035 to Banerjee et al. and U.S. Pat. No. 8,464,726 to Sebastian et al.; US Pat. Pub. Nos. 2012/0042885 to Stone et al.; 2013/0019888 to Tsuruizumi et al; 2013/0133675 to Shinozaki et al. and 2013/0146075 to Poget et al.; PCT WO Nos. 2012/0164077 to Gladden et al.; 2013/098380 to Raether et al.; 2013/098405 to Zuber et al.; 2013/098410 to Zuber et al.; 2013/104914 to Woodcock; 2013/120849 to Roudier et al.; 2013/120854 to Mironov; EP 1808087 to Baba et al. and EP 2550879 to Tsuruizumi et al.; which are incorporated by reference herein in their entirety. A historical perspective of technology related to various types of smoking products incorporating carbonaceous fuel elements for heat generation and aerosol formation may be found, for example, in the Background of US Pat. Pub. No. 2007/0215167 to Llewellyn Crooks et al., which is also incorporated herein by reference.

It would be highly desirable to provide smoking articles that demonstrate the ability to provide to a smoker many of the benefits and advantages of conventional cigarette smoking, without delivering considerable quantities of incomplete combustion and pyrolysis products. In conjunction with such desirable characteristics, it would also be desirable for a direct ignition smoking article to be readily ignited, and to remain ignited, while being used by the smoker.

BRIEF SUMMARY OF THE DISCLOSURE

The above and other needs are met by aspects of the present disclosure which, in one aspect, provides an elongate smoking article having a lighting end and an opposed mouth end. Such a smoking article comprises a mouth end portion disposed at the mouth end, and a tobacco portion disposed between the lighting end and the mouth end portion. An aerosol-generation system is disposed between the lighting end and the tobacco portion, wherein the aerosol-generation system including a heat generation portion disposed at the lighting end. The heat generation portion comprises an elongate fluted member configured to be actuated by ignition of the lighting end. The fluted member defines a plurality of grooves extending longitudinally between opposed first and second ends, wherein the first end is disposed at the lighting end and the grooves are equidistantly spaced apart about the fluted member. Each groove has a maximum depth, with the depth maxima of the grooves defining a circle having a radius, and with the maximum depth of each groove being no more than the radius of the circle.

Another aspect of the present disclosure provides a heat generation apparatus for an aerosol-generation system of an elongate smoking article, wherein the smoking article has a lighting end and an opposed mouth end, and wherein the heat generation apparatus is disposed at the lighting end of the smoking article. Such a heat generation apparatus comprises an elongate fluted member configured to be actuated by ignition of the lighting end. The fluted member defines a plurality of grooves extending longitudinally between opposed first and second ends, with the first end being disposed at the lighting end and the grooves being equidistantly spaced apart about the fluted member. Each groove has a maximum depth, with the depth maxima of the grooves defining a circle having a radius, and with the maximum depth of each groove being no more than the radius of the circle.

Embodiments of the present disclosure thus relate to smoking articles, and in particular, to rod-shaped smoking articles, such as cigarettes, wherein the smoking article includes a lighting end (i.e., an upstream end) and a mouth end (i.e., a downstream end). The smoking article also includes an aerosol-generation system that includes (i) a heat generation segment, and (ii) an aerosol-generating region or segment located downstream from the heat generation segment. The aerosol-generating segment may include a substrate including pellets or beads of marumarized or non-marumarized tobacco disposed within a substrate cavity. The substrate cavity may be circumscribed by a foil strip laminated to a wrapping material.

Further features and advantages of the present disclosure are set forth in more detail in the following description.

BRIEF DESCRIPTION OF THE DRAWINGS

Figure 1:
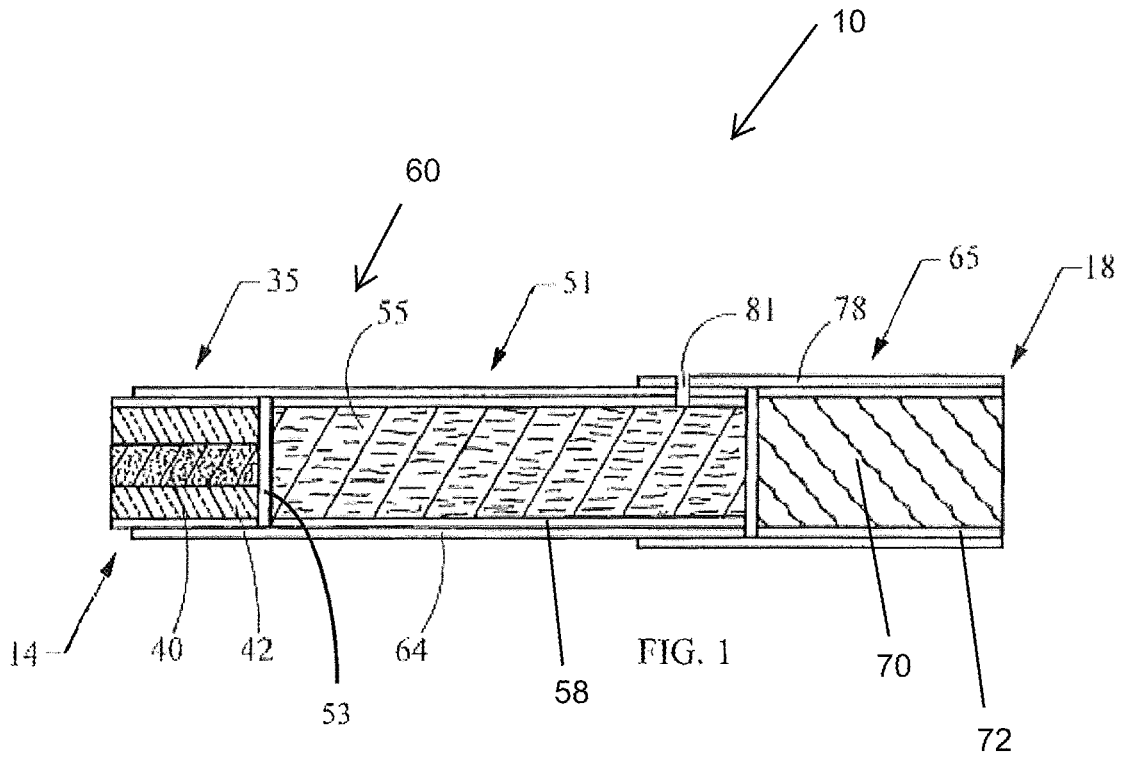
Figure 2:
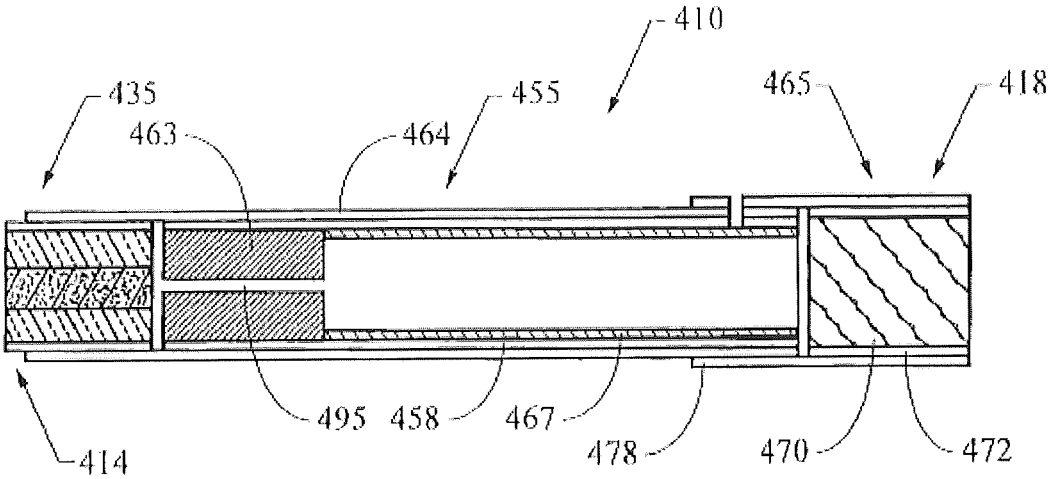
Figure 3:
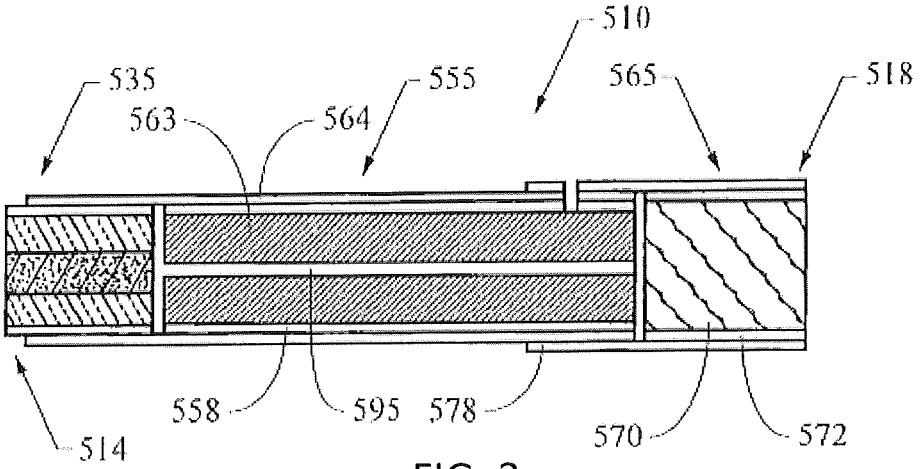
Figure 4:
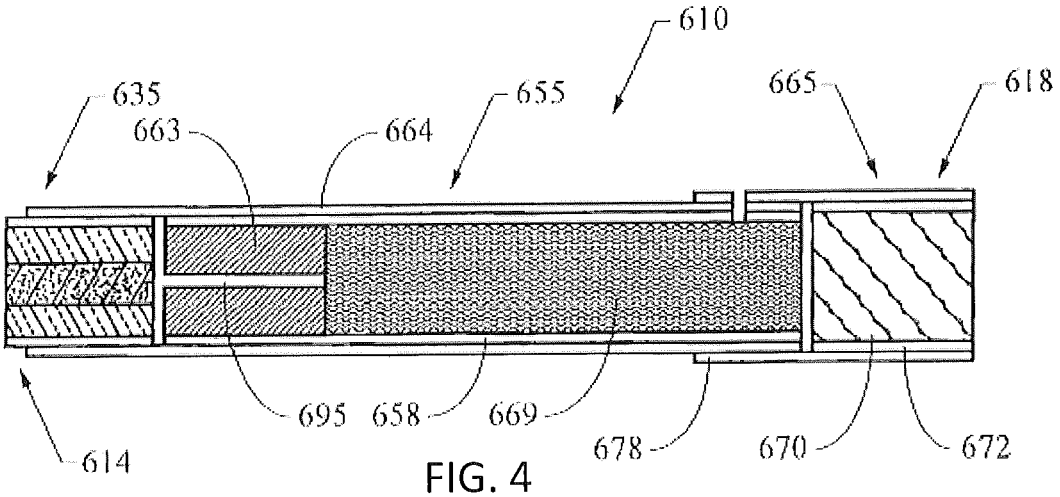
Figure 5:
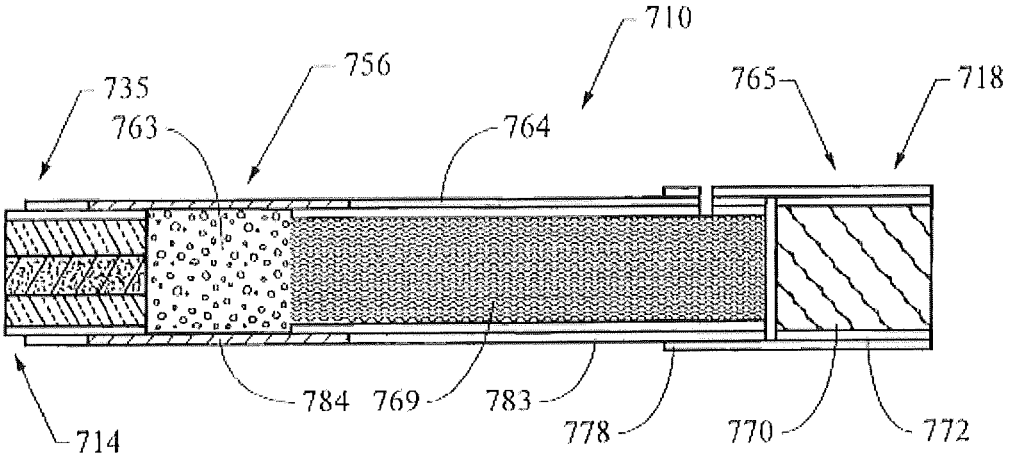
Figure 6:
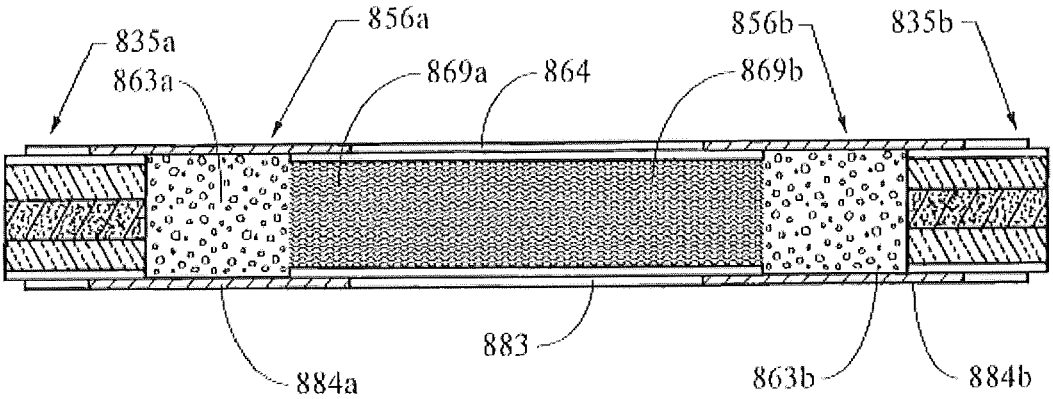
Figure 7:
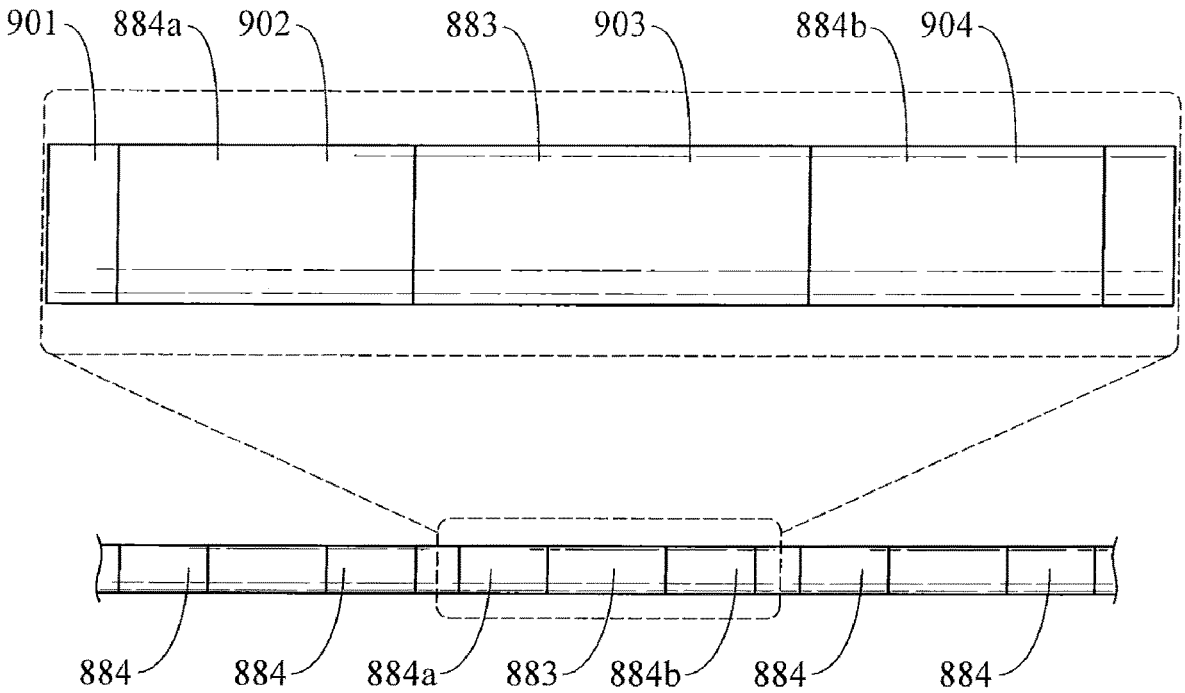
Figure 9:
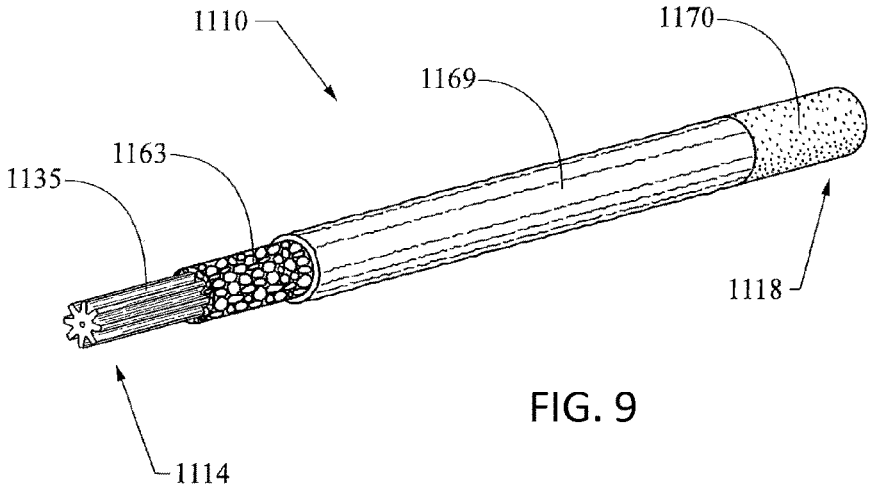
Figure 8:
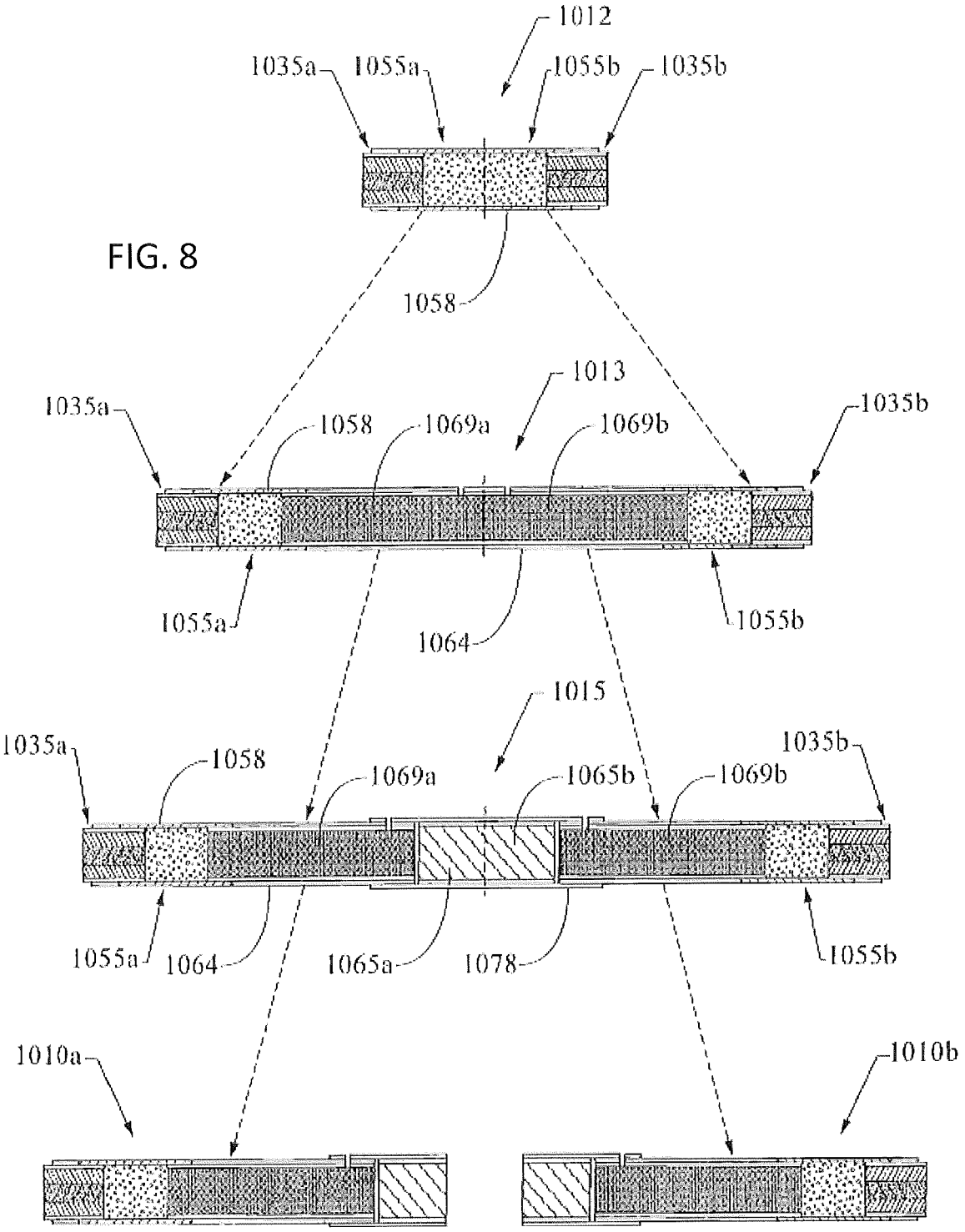

Having thus described the disclosure in general terms, reference will now be made to the accompanying drawings, which are not necessarily drawn to scale, and wherein:

FIG. 1 provides a longitudinal cross-sectional view of a representative smoking article;

FIGS. 2-4 each show a longitudinal cross-sectional view of a representative smoking article including a monolithic substrate;

FIG. 5 shows a longitudinal cross-sectional view of a representative smoking article including a tobacco pellet substrate;

FIG. 6 shows a two-up rod that may be used for manufacturing the smoking article of FIG. 5;

FIG. 7 shows a wrapping material that may be used for manufacturing the two-up rod of FIG. 6;

FIG. 8 shows one example of the construction of a smoking article;

FIG. 9 shows a representative smoking article including a tobacco pellet substrate;

FIG. 10 shows an exemplary extrusion die for a fuel source for a smoking article, according to aspects of the present disclosure, wherein the extruded fuel source is in the form of a fluted member; and FIG. 11 shows one example of a fuel source/heat generation segment for a smoking article, according to particular aspects of the present disclosure, in the form of a fluted member.

DETAILED DESCRIPTION OF THE PREFERRED EMBODIMENTS

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

Aspects and embodiments of the present disclosure relate, for example, to various smoking articles, and the arrangement of various components thereof. Exemplary smoking article construction may include features such as fibrous filter elements, foamed ceramic monoliths formed as insulators or fuel elements, and other features disclosed in U.S. Pat. No. 8,464,726 and U.S. Pat. Pub. No. 2013/0233329; both to Sebastian et al., which are incorporated herein by reference.

FIG. 1 illustrates a representative smoking article 10 in the form of a cigarette. The smoking article 10 has a rod-like shape, and includes a lighting end 14 and a mouth end 18. At the lighting end 14 is positioned a longitudinally-extending, generally cylindrical, heat generation segment 35. The heat generation segment 35 includes a heat source 40 circumscribed by insulation 42, which may be coaxially encircled by wrapping material 45. The heat source 40 preferably is configured to be activated by direct ignition of the lighting end 14. The smoking article 10 also includes a filter segment 65 located at the other end (mouth end 18), and an aerosol-generating segment 51 (which may incorporate tobacco) that is located in between those two segments.

The heat source 40 may include a combustible fuel element that has a generally cylindrical shape and can incorporate a combustible carbonaceous material. Such combustible carbonaceous materials generally have high carbon content. Preferred carbonaceous materials may be comprised predominantly of carbon, typically have carbon contents of greater than about 60 percent, generally greater than about 70 percent, often greater than about 80 percent, and frequently greater than about 90 percent, on a dry weight basis. Such combustible fuel elements can incorporate components other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). A representative fuel element, for example, has a length of about 12 mm and an overall outside diameter of about 4.2 mm. A representative fuel element can be extruded or compounded using a ground or powdered carbonaceous material, and has a density that is greater than about 0.5 $g/cm^3$, often greater than about 0.7 $g/cm^3$, and frequently greater than about 1 $g/cm^3$, on a dry weight basis. See, for example, the types of fuel element components, formulations and designs set forth in U.S. Pat. No. 5,551,451 to Riggs et al.; U.S. Pat. No. 7,836,897 to Borschke et al., and U.S. Pat. No. 5,469,871 to Barnes et al.; and US Pat. Pub. Nos. 2007/0215167 to Llewellyn Crooks et al. and 2007/0215168 to Banerjee et al.; which are incorporated herein by reference in their entirety.

Another embodiment of a fuel element 40 may include a foamed carbon monolith formed in a foam process. In another embodiment, the fuel element 40 may be co-extruded with a layer of insulation 42, thereby reducing manufacturing time and expense. Still other embodiments of fuel elements may include those of the types described in U.S. Pat. No. 4,819,665 to Roberts et al. or U.S. Pat. App. Pub. No. 2009/0044818 to Takeuchi et al., each of which is incorporated herein by reference.

A representative layer of insulation 42 can comprise glass filaments or fibers. The insulation 42 can act as a jacket that assists in maintaining the heat source 40 firmly in place within the smoking article 10. The insulation 42 can be provided as a multi-layer component including an inner layer or mat of non-woven glass filaments, an intermediate layer of reconstituted tobacco paper, and an outer layer of non-woven glass filaments. These may be concentrically oriented or each overwrapping and/or circumscribing the heat source.

In one embodiment, the inner layer of insulation may include a variety of glass or non-glass filaments or fibers that are woven, knit, or both woven and knit (such as, for example, so-called 3-D woven/knit hybrid mats). When woven, an inner layer may be formed as a woven mat or tube. A woven or knitted mat or tube can provide improved control of air flow with regard to evenness across the insulation layer (including as any thermal-related changes may occur to the layer). Those of skill in the art will appreciate that a woven, knit, or hybrid material may provide more regular and consistent air spaces/gaps between the filaments or fibers as compared to a non-woven material which is more likely to have irregularly closed and open spaces that may provide comparatively non-uniform and/or decreased air-flow. Various other insulation embodiments may be molded, extruded, foamed, or otherwise formed. Particular embodiments of insulation structures may include those described in U.S. Pat. App. Pub. No. 2012/0042885 to Stone et al., which is incorporated by reference herein in its entirety.

Preferably, both ends of the heat generation segment 35 are open to expose at least the heat source 40 and insulation 42 at the lighting end 14. The heat source 40 and the surrounding insulation 42 can be configured so that the length of both materials is co-extensive (i.e., the ends of the insulation 42 are flush with the respective ends of the heat source 40, and particularly at the downstream end of the heat generation segment). Optionally, though not necessarily preferably, the insulation 42 may extend slightly beyond (e.g., from about 0.5 mm to about 2 mm beyond) either or both ends of the heat source 40. Moreover, heat and/or heated air produced when the lighting end 14 is ignited during use of the smoking article 10 can readily pass through the heat generation segment 35 during draw by the smoker on the mouth end 18.

The heat generation segment 35 preferably is positioned with one end disposed at the lighting end 14, and is axially aligned in an end-to-end relationship with a downstream aerosol-generating segment 51, preferably abutting one another, but with no barrier (other than open air-space) therebetween. The close proximity of the heat generation segment 35 to the lighting end 14 provides for direct ignition of the heat source/fuel element 40 of the heat generation segment 35.

The cross-sectional shape and dimensions of the heat generation segment 35, prior to burning, can vary. Preferably, the cross-sectional area of the heat source 40 makes up about 10 percent to about 35 percent, often about 15 percent to about 25 percent of the total cross-sectional area of that segment 35; while the cross-sectional area of the outer or circumscribing region (comprising the insulation 42 and relevant outer wrapping materials) makes up about 65 percent to about 90 percent, often about 75 percent to about 85 percent of the total cross-sectional area of that segment 35. For example, for a cylindrical smoking article having a circumference of about 24 mm to about 26 mm, a representative heat source 40 has a generally circular cross-sectional shape with an outer diameter of about 2.5 mm to about 5 mm, often about 3 mm to about 4.5 mm.

A longitudinally extending, cylindrical aerosol-generating segment 51 is located downstream from the heat generation segment 35. The aerosol-generating segment 51 includes a substrate material 55 that, in turn, acts as a carrier for an aerosol-forming agent or material (not shown). For example, the aerosol-generating segment 51 can include a reconstituted tobacco material that includes processing aids, flavoring agents, and glycerin. The foregoing components of the aerosol-generating segment 51 can be disposed within, and circumscribed by, a wrapping material 58. The wrapping material 58 can be configured to facilitate the transfer of heat from the lighting end 14 of the smoking article 10 (e.g., from the heat generation segment 35) to components of the aerosol-generating segment 51. That is, the aerosol-generating segment 51 and the heat generation segment 35 can be configured in a heat exchange relationship with one another. The heat exchange relationship is such that sufficient heat from the heat source 40 is supplied to the aerosol-formation region to volatilize aerosol-forming material for aerosol formation. In some embodiments, the heat exchange relationship is achieved by positioning those segments in close proximity to one another. A heat exchange relationship also can be achieved by extending a heat conductive material from the vicinity of the heat source 40 into or around the region occupied by the aerosol-generating segment 51. Particular embodiments of substrates may include those described below or those described in U.S. Pat. App. Pub. No. 2012/0042885 to Stone et al., which is incorporated by reference herein in its entirety.

A representative wrapping material 58 for the substrate material 55 may include heat conductive properties to conduct heat from the heat generation segment 35 to the aerosol-generating segment 51, in order to provide for the volatilization of the aerosol forming components contained therein. The substrate material 55 may be about 10 mm to about 22 mm in length, with certain embodiments being about 11 mm up to about 21 mm. The substrate material 55 can be provided from a blend of flavorful and aromatic tobaccos in cut filler form. Those tobaccos, in turn, can be treated with aerosol-forming material and/or at least one flavoring agent. The substrate material can be provided from a processed tobacco (e.g., a reconstituted tobacco manufactured using cast sheet or papermaking types of processes) in cut filler form. Certain cast sheet constructions may include about 270 to about 300 mg of tobacco per 10 mm of linear length. That tobacco, in turn, can be treated with, or processed to incorporate, aerosol-forming material and/or at least one flavoring agent, as well as a burn retardant (e.g., diammonium phosphate or another salt) configured to help prevent ignition and/or scorching by the heat-generation segment. A metal inner surface of the wrapping material 58 of the aerosol-generating segment 51 can act as a carrier for aerosol-forming material and/or at least one flavoring agent.

In other embodiments, the substrate 55 may include a tobacco paper or non-tobacco gathered paper formed as a plug section. The plug section may be loaded with aerosol-forming materials, flavorants, tobacco extracts, or the like in a variety of forms (e.g., microencapsulated, liquid, powdered). A burn retardant (e.g., diammonium phosphate or another salt) may be applied to at least a distal/lighting-end portion of the substrate to help prevent ignition and/or scorching by the heat-generation segment. In these and/or other embodiments, the substrate 55 may include pellets or beads formed from marumarized and/or non-marumarized tobacco. Marumarized tobacco is known, for example, from U.S. Pat. No. 5,105,831 to Banerjee, et al., which is incorporated herein by reference. Marumarized tobacco may include about 20 to about 50 percent (by weight) tobacco blend in powder form, with glycerol (at about 20 to about 30 percent by weight), calcium carbonate (generally at about 10 to about 60 percent by weight, often at about 40 to about 60 percent by weight), along with binder and flavoring agents. The binder may include, for example, a carboxymethyl cellulose (CMC), gum (e.g., guar gum), xanthan, pullulan, and/or an alginate. The beads, pellets, or other marumarized forms may be constructed in dimensions appropriate to fitting within a substrate section and providing for optimal air flow and production of desirable aerosol. A container, such as a cavity or capsule, may be formed for retaining the substrate in place within the smoking article. Such a container may be beneficial to contain, for example, pellets or beads of marumarized and/or non-marumarized tobacco. The container may be formed using wrapping materials as further described below. The term "tobacco pellets" is defined herein to include beads, pellets, or other discrete small units of tobacco that may include marumarized and/or non-marumarized tobacco. The tobacco pellets may have smooth, regular outer shapes (e.g., spheres, cylinders, ovoids, etc.) and/or they may have irregular outer shapes. In one example, the diameter of each tobacco pellet may range from less than about 1 mm to about 2 mm. The tobacco pellets may at least partially fill a substrate cavity of a smoking article as described herein. In one example, the volume of the substrate cavity may range from about 500 $mm^3$ to about 700 $mm^3$ (e.g., a substrate cavity of a smoking article where the cavity diameter is about 7.5 to about 7.8 mm, and the cavity length is about 11 to about 15 mm, with the cavity having a generally cylindrical geometry). In one example, the mass of the tobacco pellets within the substrate cavity may range from about 200 mg to about 500 mg.

In still other embodiments, the substrate 55 may be configured as a monolithic substrate, formed, for example, as described in U.S. Pat. App. Pub. No. 2012/0042885 to Stone et al., which is incorporated herein by reference in its entirety. The substrate may include or be constructed from an extruded material. The substrate also may be formed by press-fit or molding/casting. Thus, the generic term "monolithic substrate" may include a substrate formed by extrusion or by one of those other methods.

In some preferred smoking articles, both ends of the aerosol-generating segment 51 are open to expose the substrate material 55 thereof. Together, the heat generating segment 35 and the aerosol-generating segment 51 form an aerosol-generation system 60. The aerosol-generating segment 51 is positioned adjacent to the downstream end of the heat generation segment 35 such that those segments 51, 35 are axially aligned in an end-to-end relationship. Those segments can abut one another, or be positioned in a slightly spaced apart relationship, which may include a buffer region 53. The outer cross-sectional shapes and dimensions of those segments, when viewed transversely to the longitudinal axis of the smoking article 10, can be essentially identical to one another. The physical arrangement of those components preferably is such that heat is transferred (e.g., by means that includes conductive and convective heat transfer) from the heat source 40 to the adjacent substrate material 55, throughout the time that the heat source is activated (e.g., burned) during use of the smoking article 10.

A buffer region 53 may reduce potential scorching or other thermal degradation of portions of the aerosol-generating segment 51. The buffer region 53 may mainly include empty air space, or it may be partially or substantially completely filled with a non-combustible material such as, for example, metal, organic, inorganic, ceramic, or polymeric materials, or any combination thereof. The buffer regions may be from about 1 mm to about 10 mm or more in thickness (length), but often will be about 2 mm to about 5 mm in thickness (length).

The components of the aerosol-generation system 60 preferably are attached to one another, and secured in place using an overwrap material 64. For example, the overwrap material 64 can include a paper wrapping material or a laminated paper-type material that circumscribes each of the heat generation segment 35, and at least a portion of outer longitudinally extending surface of the aerosol-generating segment 51. The inner surface of the overwrap material 64 may be secured to the outer surfaces of the components it circumscribes by a suitable adhesive.

The smoking article 10 preferably includes a suitable mouthpiece such as, for example, a filter element 65, positioned at the mouth end 18 thereof. The filter element 65 preferably is positioned at one end of the cigarette rod adjacent to one end of the aerosol-generating segment 51, such that the filter element 65 and the aerosol-generating segment 51 are axially aligned in an end-to-end relationship, abutting one another but without any barrier therebetween. Preferably, the general cross-sectional shapes and dimensions of those segments 51, 65 are essentially identical to one another when viewed transversely to the longitudinal axis of the smoking article. The filter element 65 may include filter material 70 that is overwrapped along the longitudinally extending surface thereof with circumscribing plug wrap material 72. In one example, the filter material 70 includes plasticized cellulose acetate tow, while in some examples the filter material may further include activated charcoal in an amount from about 20 to about 80 mg disposed as a discrete charge or dispersed throughout the acetate tow in a "Dalmatian type" filter. Both ends of the filter element 65 preferably are open to permit the passage of aerosol therethrough. The aerosol-generating system 60 preferably is attached to the filter element 65 using tipping material 78. The filter element 65 may also include a crushable flavor capsule of the type described in U.S. Pat. No. 7,479,098 to Thomas et al. and U.S. Pat. No. 7,793,665 to Dube et al.; and U.S. Pat. No. 8,186,359 to Ademe et al., which are incorporated herein by reference in their entirety.

The smoking article 10 may include an air dilution means, such as a series of perforations 81, each of which may extend through the filter element tipping material 78 and plug wrap material 72 in the manner shown, and/or which may extend to or into the substrate 55.

The overall dimensions of the smoking article 10, prior to burning, can vary. Typically, smoking articles 10 are cylindrically shaped rods having circumferences of about 20 mm to about 27 mm, have overall lengths of about 70 mm to about 130 mm—often about 83 mm to about 100 mm. Smokable lighting end segments 22 typically have lengths of about 3 mm to about 15 mm, but can be up to about 30 mm. The aerosol-generation system 60 has an overall length that can vary from about 20 mm to about 65 mm. The heat generation segment 35 of the aerosol-generation system 60 may have a length of about 5 mm to about 30 mm; and the aerosol-generating segment 51 of the aerosol-generation system 60 may have an overall length of about 10 mm to about 60 mm.

The combined amount of aerosol-forming agent and substrate material 55 employed in the aerosol-generating segment 51 can vary. The material preferably may be employed so as to fill the appropriate section of the aerosol-generating segment 51 (e.g., the region within the wrapping material 58 thereof) at a packing density of about 100 to about 400 $mg/cm^3$.

During use, the smoker lights the lighting end 14 of the smoking article 10 using a match or cigarette lighter, in a manner similar to the way that conventional smoking articles are lit, such that the heat source/fuel element 40 at the lighting end 14 is ignited. The mouth end 18 of the smoking article 10 is placed in the lips of the smoker. Thermal decomposition products (e.g., components of tobacco smoke) generated by the aerosol generation system 60 are drawn through the smoking article 10, through the filter element 65, and into the mouth of the smoker. That is, when smoked, the smoking article yields visible mainstream aerosol that resembles the mainstream tobacco smoke of traditional cigarettes that burn tobacco cut filler.

Direct ignition actuates the fuel element 40 of the heat generation segment 35 such that it preferably will be ignited or otherwise activated (e.g., begin to burn). The heat source 40 within the aerosol-generation system 60 will burn, and provide heat to volatilize aerosol-forming material within the aerosol-generating segment 51 as a result of the heat exchange relationship between those two segments. Certain preferred heat sources 40 will not experience volumetric decrease during activation, while others may degrade in a manner that reduces their volume. Preferably, the components of the aerosol-generating segment 51 do not experience thermal decomposition (e.g., charring or burning) to any significant degree. Volatilized components are entrained in the air that is drawn through the aerosol-generating region 51. The aerosol so formed will be drawn through the filter element 65, and into the mouth of the smoker.

During certain periods of use, aerosol formed within the aerosol-generating segment 51 will be drawn through the filter element 65 and into the mouth of the smoker. Thus, the mainstream aerosol produced by the smoking article 10 includes tobacco smoke produced by the volatilized aerosol-forming material.

As previously disclosed, the filter element 65 preferably is attached to the cigarette rod so formed using a tipping material 78. The smoking article optionally can be air-diluted by providing appropriate perforations 81 in the vicinity of the mouth end region 18, as is known in the art. Filters may include materials and may be manufactured by methods such as, for example, those disclosed in U.S. Pat. No. 7,740,019 to Nelson et al., U.S. Pat. No. 7,972,254 to Stokes et al., U.S. Pat. No. 8,375,958 to Hutchens et al.; and U.S. Pat. Publ. Nos. 2008/0142028 to Fagg, et al.; and 2009/0090372 to Thomas et al., each of which is incorporated herein by reference.

Flavor may be provided or enhanced by capsule or microcapsule materials on or within the substrate material 55 of the aerosol-generating segment 51, the wrapping materials, the filter element 65, or any other component capable of holding and releasing flavorants, preferably with minimal thermal degradation that would undesirably alter the flavor. Other flavor components associated with a filter may also be used; see, for example, U.S. Pat. No. 5,724,997 to Fagg, et al.

Cigarettes described with reference to FIG. 1 may be used in much the same manner as those cigarettes commercially marketed under the trade name "Eclipse" by R. J. Reynolds Tobacco Company. See also the "Steam Hot One" cigarette marketed by Japan Tobacco Inc.

Fuel elements of the heat generation segment may vary. Suitable fuel elements, and representative components, designs and configurations thereof, and manners and methods for producing those fuel elements and the components thereof, are set forth in U.S. Pat. No. 4,714,082 to Banerjee et al.; U.S. Pat. No. 4,756,318 to Clearman et al.; U.S. Pat. No. 4,881,556 to Clearman et al.; U.S. Pat. No. 4,989,619 to Clearman et al.; U.S. Pat. No. 5,020,548 to Farrier et al.; U.S. Pat. No. 5,027,837 to Clearman et al.; U.S. Pat. No. 5,067,499 to Banerjee et al.; U.S. Pat. No. 5,076,297 to Farrier et al.; U.S. Pat. No. 5,099,861 to Clearman et al.; U.S. Pat. No. 5,105,831 to Banerjee et al.; U.S. Pat. No. 5,129,409 to White et al.; U.S. Pat. No. 5,148,821 to Best et al.; U.S. Pat. No. 5,156,170 to Clearman et al.; U.S. Pat. No. 5,178,167 to Riggs et al.; U.S. Pat. No. 5,211,684 to Shannon et al.; U.S. Pat. No. 5,247,947 to Clearman et al.; U.S. Pat. No. 5,345,955 to Clearman et al.; U.S. Pat. No. 5,469,871 to Barnes et al.; U.S. Pat. No. 5,551,451 to Riggs; U.S. Pat. No. 5,560,376 to Meiring et al.; U.S. Pat. No. 5,706,834 to Meiring et al.; U.S. Pat. No. 5,727,571 to Meiring et al.; U.S. Pat. No. 8,469,035 to Banerjee et al.; and U.S. Pat. App. Pub. Nos. 2005/0274390 to Banerjee et al.; and 2013/0269720 to Stone et al.; which are incorporated herein by reference.

Fuel elements often comprise carbonaceous material and may include ingredients such as graphite or alumina, as well as high carbon content carbonaceous material. Carbonaceous fuel elements include the type that have been incorporated within those cigarettes commercially marketed under the trade names "Premier" and "Eclipse" by R. J. Reynolds Tobacco Company. See also the "Steam Hot One" cigarette marketed by Japan Tobacco Inc. Some other embodiments of fuel elements are set forth in U.S. Pat. No. 5,178,167 to Riggs et al. and U.S. Pat. No. 5,551,451 to Riggs et al., both which are incorporated herein by reference in their entirety, but certain embodiments may lack the sodium, graphite, and/or calcium carbonate set forth therein. Some fuel element embodiments may include a foamed carbon monolith. In another embodiment, the fuel element 40 may be co-extruded with a layer of insulation 42, thereby reducing manufacturing time and expense.

Fuel elements may be treated (e.g., dip-coated) with various precursors (e.g., a metal nitrate or metal oxide) and/or subjected to heat treatment. Such treatment may provide a reduced CO concentration in mainstream aerosol generated by a smoking article including a treated fuel element as compared to a smoking article including an untreated fuel element. Such fuel elements are further described in U.S. Pat. App. Pub. No. 2012/0042885 to Stone et al., which is incorporated herein by reference in its entirety.

The fuel element preferably will be circumscribed or otherwise jacketed by insulation, or other suitable material. The insulation can be configured and employed so as to support, maintain and retain the fuel element in place within the smoking article. The insulation may additionally be configured such that drawn air and aerosol can pass readily therethrough. Examples of insulation materials, components of insulation assemblies, configurations of representative insulation assemblies within heat generation segments, wrapping materials for insulation assemblies, and manners and methods for producing those components and assemblies, are set forth in U.S. Pat. No. 4,807,809 to Pryor et al.; U.S. Pat. No. 4,893,637 to Hancock et al.; U.S. Pat. No. 4,938,238 to Barnes et al.; U.S. Pat. No. 5,027,836 to Shannon et al.; U.S. Pat. No. 5,065,776 to Lawson et al.; U.S. Pat. No. 5,105,838 to White et al.; U.S. Pat. No. 5,247,947 to Clearman et al.; U.S. Pat. No. 5,303,720 to Banerjee et al.; U.S. Pat. No. 5,345,955 to Clearman et al.; U.S. Pat. No. 5,396,911 to Casey, III et al.; U.S. Pat. No. 5,546,965 to White; U.S. Pat. No. 5,727,571 to Meiring et al.; U.S. Pat. No. 5,902,431 to Wilkinson et al.; U.S. Pat. No. 5,944,025 to Cook et al.; U.S. Pat. No. 8,424,538 to Thomas et al.; and U.S. Pat. No. 8,464,726 to Sebastian et al.; which are incorporated herein by reference. Insulation assemblies have been incorporated within the types of cigarettes commercially marketed under the trade names "Premier" and "Eclipse" by R. J. Reynolds Tobacco Company, and as "Steam Hot One" cigarette marketed by Japan Tobacco Inc.

Flame/burn retardant materials and additives useful in insulation may include silica, carbon, ceramic, metallic fibers and/or particles. When treating cellulosic or other fibers such as—for example—cotton, boric acid or various organophosphate compounds may provide desirable flame-retardant properties. In addition, various organic or metallic nanoparticles may confer a desired property of flame-retardancy, as may diammonium phosphate and/or other salts. Other useful materials may include organo-phosphorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium chloride, ammonium borate, ethanolammonium borate, ammonium sulphamate, halogenated organic compounds, thio-urea, and antimony oxides may be used but are not preferred agents. In each embodiment of flame-retardant, burn-retardant, and/or scorch-retardant materials used in insulation, substrate material and other components (whether alone or in any combination with each other and/or other materials), the desirable properties most preferably are provided without undesirable off-gassing or melting-type behavior.

An insulation fabric preferably will have sufficient oxygen diffusion capability to sustain a smoking article such as a cigarette in a lit condition during a desired usage time. Accordingly the insulation fabric preferably will be porous by virtue of its construction. In knit, woven, or combined woven and knit constructions, the required porosity may be controlled by configuring the assembly machinery to leave sufficient (desirably sized) gaps between fibers to allow for oxygen diffusion into the heat source. For non-woven fabrics, which may not be porous enough to promote evenly sustained combustion, additional porosity may be achieved by perforations into the insulation by methods known in the art including, for example, hot or cold pin perforation, flame perforation, embossing, laser cutting, drilling, blade cutting, chemical perforation, punching, and other methods. Each of the buffer and the insulation may include non-glass material that is woven, knit, or a combination thereof, a foamed metal material, a foamed ceramic material, a foamed ceramic metal composite, and any combination thereof, and the material in the insulation may be the same as or different than that in the buffer.

The aerosol-forming material can vary, and mixtures of various aerosol-forming materials can be used, as can various combinations and varieties of flavoring agents (including various materials that alter the sensory and/or organoleptic character or nature of mainstream aerosol of a smoking article), wrapping materials, mouth-end pieces, filter elements, plug wrap, and tipping material. Representative types of these components are set forth in U.S. Pat. App. Pub. No. 2007/0215167 to Llewellyn Crooks, et al., which is incorporated herein by reference in its entirety.

The substrate material can incorporate tobacco of some form, normally is composed predominantly of tobacco, and can be provided by virtually all tobacco material. The form of the substrate material can vary. In some embodiments, the substrate material is employed in an essentially traditional filler form (e.g., as cut filler). The substrate material can be otherwise formed into desired configurations (see, e.g., U.S. Pat. Pub. No. 2011/0271971 to Conner et al., which is incorporated herein by reference). The substrate material can be used in the form of a gathered web or sheet, using the types of techniques generally set forth in U.S. Pat. No. 4,807,809 to Pryor et al, which is incorporated herein by reference in its entirety. The substrate material can be used in the form of a web or sheet that is shredded into a plurality of longitudinally extending strands, using the types of techniques generally set forth in U.S. Pat. No. 5,025,814 to Raker, which is incorporated herein by reference in its entirety. The substrate material can have the form of a loosely rolled sheet, such that a spiral type of air passageway extends longitudinally through the aerosol-generating segment. Representative types of tobacco containing substrate materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco).

The substrate material also can be treated with tobacco additives of the type that are traditionally used for the manufacture of cigarettes, such as casing and/or top dressing components. See, for example, the types of components set forth in U.S. Pat. Publication 2004/0173229 to Crooks et al., which is incorporated herein by reference in its entirety.

The manner by which the aerosol-forming material is contacted with the substrate material (e.g., the tobacco material) can vary. The aerosol-forming material can be applied to a formed tobacco material, or can be incorporated into processed tobacco materials during manufacture of those materials. The aerosol-forming material can be dissolved or dispersed in an aqueous liquid, or other suitable solvent or liquid carrier, and sprayed onto that substrate material. See, for example, U.S. Patent Application Pub. No. 2005/0066986 to Nestor et al, which is incorporated herein by reference in its entirety. The amount of aerosol-forming material employed relative to the dry weight of substrate material can vary. Materials including exceedingly high levels of aerosol-forming material can be difficult to process into cigarette rods using conventional types of automated cigarette manufacturing equipment.

Cast sheet types of materials may incorporate relatively high levels of aerosol-forming material. Reconstituted tobaccos manufactured using paper-making types of processes may incorporate moderate levels of aerosol-forming material. Tobacco strip and tobacco cut filler can incorporate lower amounts of aerosol-forming material. Various paper and non-paper substrates including gathered, laminated, laminated metal/metallic, strips, beads such as alumina beads, open cell foam, foamed monolith, air permeable matrices, and other materials can be used within the scope of the disclosure. See, for example, U.S. Pat. Nos. 5,183,062; 5,203,355; and each to Clearman, and each of which is incorporated herein by reference.

In other embodiments, the substrate portion of an aerosol-generation segment may include or may be constructed from an extruded or other monolithic material. An extruded substrate may be formed in the same manner as described herein with reference to other extruded components. The extruded or other monolithic substrate may include, or may be essentially comprised of, tobacco, glycerin, water, and binder material. In certain embodiments, a monolithic substrate may include about 10 to about 90 weight-percent tobacco, about 5 to about 50 weight-percent glycerin, about 1 to about 30 weight-percent water (before being dried and cut), and about 0 to about 10 weight-percent binder. It may also include a filler such as, for example, calcium carbonate and/or graphite.

Following extrusion, drying, and cutting to a desired length, the substrate may be assembled into a segmented smoking article such as an Eclipse-type cigarette using a manual assembly method or a cigarette-making machine (e.g., KDF or Protus by Hauni Maschinenbau AG). Smaller diameter monolithic substrate elements may be combined by being wrapped, adhered, or otherwise assembled together for use in a smoking article as described for other substrate embodiments herein. Preferred substrate wraps include foil paper, heavy-gauge paper, plug wrap, and/or cigarette paper.

In one embodiment, a smoking article may be constructed with a monolithic substrate 463, described here with reference to FIG. 2, which is a longitudinal section view of a cigarette 410 having a lighting end 414 and a mouth end 418. The monolithic substrate 463 (which may be used in other embodiments such as, for example, those discussed with reference to FIG. 1) may be formed by any appropriate extrusion method and is shown with a center-hole 495 extending longitudinally therethrough. The monolithic substrate, cut to length may comprise about 1/16 to about 5/8 of the total length of the cigarette, often about 1/10 to about 1/2 thereof (e.g., a 10 mm, 12 mm, or 50 mm long substrate element in an 85 mm or 130 mm long cigarette). The substrate segment 455 of the cigarette body includes a hollow spacing tube 467 disposed between the substrate 463 and the filter 470. The filter 470 is shown as constructed with overlying layers of plug wrap 472 and tipping paper 478. The substrate 463 and tube 467 are surrounded by a wrapping material 458, which may be configured—for example—as a heat-conducting material (e.g., foil paper), heavy-gauge paper, plug wrap, or cigarette paper. A cylindrically-encompassing wrapping material 464 (such as, for example, cigarette paper or heavy-gauge paper) may be provided to connect the heat-generation segment 435, central substrate segment 455, and filter segment 465. The heat-generation segment 435 and other components may be constructed as described herein and elsewhere in this and other embodiments configured to be practiced within the scope of the present disclosure.

In another embodiment, a smoking article may be constructed with an elongate monolithic substrate 563, described here with reference to FIG. 3, which is a longitudinal section view of a cigarette 510 having a lighting end 514 and a mouth end 518. The elongate monolithic substrate 563 (which may be used in other embodiments) may be formed by any appropriate extrusion method and is shown with a center-hole 595 extending longitudinally therethrough. The filter 570 is shown as constructed with overlying layers of plug wrap 572 and tipping paper 578. The substrate 563 is surrounded by a wrapping material 558, which may be configured—for example—as a heat-conducting material (e.g., foil paper), heavy-gauge paper, plug wrap, or cigarette paper. A cylindrically-encompassing wrapping material 564 (such as, for example, cigarette paper or heavy-gauge paper) may be provided to connect the heat-generation segment 535, central substrate segment 555 (consisting essentially of the substrate in this embodiment), and filter segment 565. The heat-generation segment 535 and other components may be constructed as described herein and elsewhere in this and other embodiments configured to be practiced within the scope of the present disclosure.

In one embodiment, a smoking article may be constructed with a monolithic substrate 663, described here with reference to FIG. 4, which is a longitudinal section view of a cigarette 610 having a lighting end 614 and a mouth end 618. The monolithic substrate 663 (which may be used in other embodiments) may be formed by any appropriate extrusion method and is shown with a center-hole 695 extending longitudinally therethrough. The cigarette body includes a tobacco rod 669 disposed between the substrate 663 and the filter 670. The filter 670 is shown as constructed with overlying layers of plug wrap 672 and tipping paper 678. The substrate segment 655, formed by the substrate 663 and tobacco rod 669, is surrounded by a wrapping material 658, which may be configured—for example—as a heat-conducting material (e.g., foil paper), heavy-gauge paper, plug wrap, or cigarette paper. A cylindrically-encompassing wrapping material 664 (such as, for example, cigarette paper or heavy-gauge paper) may be provided to connect the heat-generation segment 635, central substrate segment 655, and filter segment 665. The heat-generation segment 635 and other components may be constructed as described herein and elsewhere in this and other embodiments configured to be practiced within the scope of the present disclosure.

In another embodiment, a smoking article may be constructed with a substrate 763 including tobacco pellets, described here with reference to FIG. 5, which is a longitudinal section view of a cigarette 710 having a lighting end 714 and a mouth end 718. The substrate 763 (which may be used in other embodiments) may be formed by any appropriate method, such as a marumarization method. The cigarette body includes a tobacco rod 769 disposed between the substrate 763 and the filter 770. The filter 770 is shown as constructed with overlying layers of plug wrap 772 and tipping paper 778. The heat-generation segment 735 and other components may be constructed as described herein and elsewhere in this and other embodiments configured to be practiced within the scope of the present disclosure.

The substrate 763 may be contained within a substrate cavity 756 (see, e.g., U.S. Pat. Pub. No. 2012/0067360 to Conner et al., which is incorporated herein by reference). The substrate cavity 756 may be formed by the heat-generation segment 735 at one end, the tobacco rod 769 at the opposite end, and a wrapping material 764 around the circumference of at least the substrate (and—in some embodiments—extending along an entire length from the filter to the lighting end). A cylindrical container structure (not shown) may circumferentially encompass the substrate cavity 756 within the wrapping material 764 and between the heat-generation segment 735 at one end and the tobacco rod 769 at the opposite end. The heat-generation segment 735 and the tobacco rod 769 may be joined to one another by the wrapping material 764. To that end, the wrapping material 764 may circumscribe at least a downstream portion of the heat-generation segment 735 and at least an upstream portion of the tobacco rod 769. The heat-generation segment 735 and the tobacco rod 769 may be spaced longitudinally from one another. In other words, the heat-generation segment 735 and the tobacco rod 769 may not be in abutting contact with one another. The substrate cavity 756 may be defined by a space extending longitudinally within the wrapping material 764 between the downstream end of the heat-generation segment 735 and the upstream end of the tobacco rod 769 as shown in FIG. 5. The substrate 763 may be positioned within the substrate cavity 756. For example, the substrate cavity 756 may be at least partially filled with tobacco pellets. The substrate cavity 756 may contain the substrate 763 to prevent migration of the tobacco pellets.

The wrapping material 764 may be configured, for example, as a heat-conducting material (e.g., foil paper), insulating material, heavy-gauge paper, plug wrap, cigarette paper, tobacco paper, or any combination thereof. Additionally, or alternatively, the wrapping material 764 may include foil, ceramic, ceramic paper, carbon felt, glass mat, or any combination thereof. Other wrapping materials known or developed in the art may be used alone or in combination with one or more of these wrapping materials. In one embodiment, the wrapping material 764 may include a paper material having strips or patches of foil laminated thereto. The wrapping material 764 may include a paper sheet 783. The paper sheet 783 may be sized and shaped to circumscribe the heat-generation segment 735, the substrate cavity 756, and the tobacco rod 769 as described above. To that end, the paper sheet 783 may be substantially rectangular in shape with a length extending along the longitudinal direction of the smoking article and a width extending in a direction transverse to the longitudinal direction. The width of the paper sheet 783 may be slightly larger than the circumference of the smoking article 710 so that the paper sheet may be formed into a tube or a column defining an outer surface of the smoking article. For example, the width of the paper sheet 783 may be from about 18 to about 29 mm. The length of the paper sheet 783 may be sufficient to extend longitudinally along an entire length of the substrate cavity 764 and to overlap the heat-generation segment 735 and the tobacco rod 769. For example, the length of the paper sheet 783 may be about 50 to about 66 mm. The paper sheet 783 may have a length sufficient to overlap substantially an entire length of the tobacco rod 769 as shown in FIG. 5. In one example, the paper sheet (or other wrapping material) may have a thickness of about 1 mil to about 6 mil (about 0.025 mm to about 0.15 mm).

A foil strip or patch 784 may be laminated to the paper sheet 783 to form a laminated coated region. The foil strip 784 may have a width extending along substantially the entire width of the paper sheet 783 to circumscribe substantially the entire circumference of the heat-generation segment 735, the substrate cavity 764, and the tobacco rod 769 as further described below. The foil strip 784 also may have a length extending along a portion of the length of the paper sheet 783. Preferably, the foil strip 784 may extend along a sufficient portion of the length of the paper sheet 783 such that the foil strip extends along the entire length of the substrate cavity 756 and overlaps at least a portion of the heat-generation segment 735 and the tobacco rod 769. For example, the length of the foil strip 784 may be from about 16 to about 20 mm. In one example, the foil strip may have a thickness of about 0.0005 mm to about 0.05 mm.

The foil strip may be laminated on an interior or an exterior surface of the paper sheet. The foil strip may be laminated on the paper sheet using any now known or future developed technique including, for example, heat laminating. The foil strip may be laminated on the paper sheet using any now known or future developed adhesive. In one example, the adhesive may be configured as a cold glue adhesive of the type used to secure tipping materials to other components of a cigarette. The foil strip may be laminated or patched to the paper sheet with or without a lubricant. Preferably, the foil strip may be laminated to the interior surface of the paper sheet (e.g., the surface of the paper sheet that faces toward the substrate cavity) to contact the heat-generation segment, the substrate material, and/or the tobacco rod. The laminated paper or other wrapping material may be constructed in accordance with the disclosure of U.S. Pat. No. 6,849,085 to Marton, which is incorporated herein by reference in its entirety, or in accordance with other appropriate methods and/or materials. For example, the foil strip may circumferentially encompass and extend lengthwise along at least a lengthwise portion of the substrate cavity and may overlap at least a lengthwise portion of the heat generation segment and/or a lengthwise portion of the tobacco rod. The foil strip may enhance heat transfer between the heat-generation segment 735 and the substrate 764. Such enhanced heat transfer may aid in volatilizing the aerosol-forming material in the substrate 763 for aerosol formation. To that end, the foil strip 784 may be formed from a heat conducting material. The foil strip 784 may be formed from any heat conducting material including, for example, tin, aluminum, copper, gold, brass, other thermoconductive materials, and/or any combination thereof. In this manner, the substrate cavity 756 may be defined by a foil-lined paper tube or column formed by the wrapping material 764. The wrapping material may include a registered facing of the foil strip at a discrete location on the wrapping material.

An intermediate segment of a smoking article may include a heat-generation segment, a substrate segment (e.g., a monolithic substrate or a substrate cavity including pellets or beads of substrate material), and a tobacco rod. It may be desirable to provide such an intermediate segment from so-called "two-up" rods that may be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; U.S. Pat. No. 6,229,115 to Vos et al.; U.S. Pat. No. 7,434,585 to Holmes; and U.S. Pat. No. 7,296,578 to Read, Jr.; and U.S. Pat. Appl. Pub. No. 2006/0169295 to Draghetti, each of which is incorporated by reference herein.

For example, FIG. 6 illustrates a two-up rod that may be produced in the process of manufacturing a smoking article 710 of FIG. 5, or other smoking article described herein. The two-up rod may include two intermediate segments as described above, the intermediate segments being joined to one another at a common tobacco rod. The two-up rod may include two heat-generation segments 835*a*, 835*b* positioned at opposite longitudinal ends thereof. A tobacco rod 869 may be substantially centered along the longitudinal axis of the rod. The tobacco rod 869 may include two portions 869*a*, 869*b* each associated with one intermediate segment. The tobacco rod 869 and the two heat-generation segments 835*a*, 835*b* may be joined to one another with wrapping material 864 as described above with reference to FIG. 5. A substrate cavity 856*a* may be defined within the wrapping material 864 between the heat-generation segment 835*a* and the tobacco rod 869. A substrate 863*a* may be contained within the substrate cavity 856*a*. Likewise, a substrate cavity 856*b* may be defined within the wrapping material 864 between the heat-generation segment 835*b* and the tobacco rod 869. A substrate 863*b* may be contained within the substrate cavity 856*b*. The wrapping material 864 may include a paper sheet 883 with foil strips 884*a*, 884*b* laminated thereto. The foil strips may be generally aligned with the substrate cavities as described above with reference to FIG. 5. The rod may be severed at about its longitudinal center to form two intermediate segments, each generally configured as described above. A tobacco rod, a hollow tube, and/or a filter element may be attached to the downstream end of each intermediate segment by any means to form a smoking article as described above. The method may include providing the wrapping material circumscribing at least a portion of the heat generation segment, the substrate cavity, the tobacco rod, the second substrate cavity, and at least a portion of the second heat generation segment, a second foil strip of the wrapping material circumscribing the second substrate cavity, wherein the foil strip and the second foil strip are registered at a discrete interval apart from each other, said interval calibrated to accurately and repeatably dispose the foil strip and the second foil strip at a desired location relative to the substrate cavity, the second substrate cavity, the heat generation segment, and the second heat generation segment.

Such a two-up rod and/or an intermediate segment may facilitate handling of the substrate material during manufacturing of a smoking article. For example, a two-up rod and/or an intermediate segment may be processed using standard processing equipment as described above while retaining the tobacco pellets substrate 863 between the heat generation segment 835 and the tobacco rod 869 and within the substrate cavity 856. In other words, the tobacco pellets substrate may be contained within the two-up rod and/or intermediate segment so that further processing may be completed while avoiding migration and/or loss of the tobacco pellets substrate.

The wrapping material 864 may be provided as a continuous tape of material having foil strips 884 laminated thereto in a repeating pattern. FIG. 7 illustrates a portion of the tape of wrapping material 864 including one repeat unit of the repeating pattern. In certain preferred embodiments, foil strips 884 may be precisely registered along the wrapping material 864 such that each foil strip will align with a substrate cavity as described above when the wrapping material is used to form the two-up rods also as described above.

In one example, a repeat unit of the repeating pattern may include a series of segments extending in a longitudinal direction along the wrapping material 864. A first segment 901 may include unlaminated paper. In other words, the first segment 901 may include paper material without a foil strip laminated thereto. The first segment may have a length of about 4 to about 8 mm. A second segment 902 may extend longitudinally from the first segment 901 and may include foil laminated paper. In other words, the second segment 902 may include paper material with a foil strip laminated thereto, such that the paper material (or other wrapping material) is continuous, with precisely registered foil strips laminated thereto at discrete predetermined location intervals. The second segment 902 may have a length of about 16 to about 20 mm. A third segment 903 may extend longitudinally from the second segment 902 and may include unlaminated paper. The third segment 903 may have a length of about 14 to about 18 mm. A fourth segment 904 may extend longitudinally from the third segment 903 and may include foil laminated paper. The fourth segment 904 may have a length of about 16 to about 20 mm.

The repeat unit may be repeated any number of times to form a tape of wrapping material 864 having any length appropriate for use on a bobbin or other structure configured to provide wrapping material to a cigarette assembly machine. As will be recognized by one of ordinary skill in the art, the positioning of the foil strips along the wrapping material preferably will be precisely controlled. Any variation in the positioning may lead to misalignment between a foil strip and a substrate cavity. The tape of wrapping material may be severed, for example, at approximately the longitudinal center of the first segment 901 to form a piece of wrapping material suitable for assembling a single two-up rod as described above. Optical monitoring devices and/or other monitoring devices may be included in or with an assembly machine and incorporated into its operation to maintain accurate alignment/registration of the foil segments with other smoking article components (e.g., heat element segment, substrate segment) during assembly of smoking articles.

FIG. 8 illustrates another example of the construction of a smoking article using a two-up rod. A two-up aerosol generation segment 1012 may be provided. The two-up aerosol generation segment may include two aerosol generation segments joined to one another. For example, the two-up aerosol generation segment 1012 may include two heat generation segments 1035*a*, 1035*b* positioned at opposite longitudinal ends thereof. A substrate segment 1055 may be substantially centered between the heat generation segments 1035*a*, 1035*b* along the longitudinal axis of the two-up aerosol generation segment 1012. The substrate segment 1055 may include two substrate segments 1055*a*, 1055*b* each associated with one aerosol generation segment. The heat generation segments 1035*a*, 1035*b* and the substrate segments 1055*a*, 1055*b* may be joined to one another by a circumscribing wrapping material 1058. The wrapping material 1058 may be constructed as described herein and elsewhere in this and other embodiments configured to be practiced within the scope of the present disclosure. For example, the wrapping material 1058 may circumscribe at least a portion of the heat generation segment 1035*a*, the substrate segments 1055*a*, 1055*b*, and at least a portion of the second heat generation segment 1035*b*. The wrapping material 1058 may include a foil strip laminated thereto as described above. The foil strip may enhance heat transfer between the heat generation segments and the substrate segments.

The components of the two-up aerosol generation segment 1012 may be constructed as described herein and elsewhere in this and other embodiments configured to be practiced within the scope of the present disclosure. For example, the substrate segment may include any type of substrate including, for example, a monolithic substrate or tobacco pellet substrate. The substrate segment may be formed as a single segment of substrate material (e.g., a single piece of extruded monolithic substrate material or a single segment of tobacco pellet substrate material) or multiple segments of substrate material (e.g., two or more pieces of extruded monolithic substrate material or two or more segments of tobacco pellet substrate material). The substrate may be disposed within a cylindrical container structure. For example, the substrate segment 1055 may include two segments 1055*a*, 1055*b* each including a substrate cavity or container at least partially filled with tobacco pellet substrate material. The substrate cavity or container may be defined by the wrapping material 1058. Alternatively, a discrete substrate cavity or container may be disposed within the wrapping material 1058.

The two-up aerosol generation segment 1012 may be severed at about its longitudinal center to form two heat generation segments, each generally configured as described above. The two heat generation segments may be positioned at opposite ends of a tobacco rod 1069, as shown in FIG. 8, to form a two-up rod 1013. The two-up rod 1013 may be configured generally as described with reference to FIG. 6. For example, the two-up rod 1013 may include two intermediate segments joined to one another at a common tobacco rod as described above. The tobacco rod 1069 may include two portions 1069*a*, 1069*b* each associated with one intermediate segment. The tobacco rod 1069 and the two aerosol generation segments may be joined to one another with wrapping material 1064. The wrapping material 1064 may circumscribe at least a portion of each aerosol generation segment (e.g., at least a portion of the substrate segments 1055*a*, 1055*b* and/or at least a portion of the heat generation segments 1035*a*, 1035*b*) and the tobacco rod 1069.

The two-up rod may be severed at about its longitudinal center to form two intermediate segments. The two intermediate segments may be positioned at opposite ends of a filter segment 1065, as shown in FIG. 8, to form a two-up cigarette rod 1015. The two-up cigarette rod may include two intermediate segments joined to one another at a common filter segment 1065. The filter segment 1065 may include two portions 1065*a*, 1065*b* each associated with one cigarette rod. The filter segment 1065 and the two intermediate segments may be joined to one another with wrapping material 1078. For example, wrapping material 1078 may circumscribe at least a portion of each intermediate segment (e.g., a portion of each tobacco rod 1069*a*, 1069*b*) and the filter segment 1065. The wrapping material 1078 may be configured as a tipping material as described above. The two-up cigarette rod may be severed at about its longitudinal center (i.e., at about the longitudinal center of the filter segment 1065) to form two smoking articles 1010*a*, 1010*b*. The smoking articles may be constructed as described herein and elsewhere in this and other embodiments configured to be practiced within the scope of the present disclosure.

In another embodiment, a smoking article may be constructed with a substrate 1163 including tobacco pellets, described here with reference to FIG. 9, which is a partial perspective view of a cigarette 1110 having a lighting end 1114 and a mouth end 1118. The substrate 1163 (which may be used in other embodiments) may be formed by any appropriate method, such as a marumarization method. The cigarette body includes a tobacco rod 1169 disposed between the substrate 1163 and the filter 1170. In any instance, smoking articles of the type disclosed herein may be assembled as otherwise disclosed, for example, in U.S. Pat. No. 5,469,871 to Barnes et al. or U.S. Pat. App. Pub. No. 2012/0042885 to Stone et al. or 2010/0186757 to Crooks et al., each being incorporated herein by reference.

In another aspect, the heat-generation portion, heat-generation apparatus, or heat-generation segment 35, 435, 535, 635, 735, 835, 1035, 1135, and other components thereof, may be constructed as described herein and elsewhere in this and other embodiments configured to be practiced within the scope of the present disclosure. For example, in one aspect, the heat-generation segment 35, 435, 535, 635, 735, 835, 1035, 1135/fuel source 40 may comprise an elongate fluted member 1300 configured to be actuated by ignition of the lighting end 1314. More particularly, the fluted member 1300 may be configured to define a plurality of grooves 1310 extending longitudinally from a first end 1320 of the fluted member 1300 (i.e., longitudinally from the first end, but not necessarily completely along the length of the fluted member), or between opposed first and second ends 1314, 1318 of the fluted member 1300 (completely along the length of the fluted member), wherein the first end 1310 of the fluted member 1300 is generally disposed at the lighting end of the cigarette. In some aspects, the grooves 1320 are equidistantly spaced apart about the fluted member 1300 (see, e.g., the cross-section of a representative fluted member as represented by an exemplary extrusion die used to form the same—for the sake of simplicity, the elements of an exemplary fluted member are referred to herein in the negative with respect to the die of FIG. 10). Each groove 1320 has a maximum depth 1330, with the depth maxima of the grooves, spaced apart about the fluted member, collectively defining a circle 1340 having a radius, wherein the maximum depth of each groove is no more than the radius of the circle defined by the depth maxima of the grooves. In some aspects, the maximum depth of each groove is no less than about 40% of the radius of the circle. One such embodiment of the heat-generation segment may involve the fluted member being configured as a monolithic extrusion of a single carbonaceous material, and/or as otherwise disclosed herein. Accordingly, FIG. 10 illustrates an exemplary cross section of such a fluted member 1300 from the perspective of an extrusion die used to extrude the fluted member. FIG. 11 illustrates an exemplary fluted member 1300 produced, for example, by extrusion through the extrusion die.

The aspects of the present disclosure described herein with respect to the various configurations of the heat-generation apparatus 35, 435, 535, 635, 735, 835, 1035, 1135/fuel source 40 address various shortcomings of previous configurations. For example, some aspects disclosed herein address difficulties encountered in igniting the heat-generation apparatus 35, 435, 535, 635, 735, 835, 1035, 1135/fuel source 40 in a cigarette configured for direct ignition of the heat-generation apparatus 35, 435, 535, 635, 735, 835, 1035, 1135/fuel source 40 at the lighting end. That is, aspects of the present disclosure are directed to configurations of the heat-generation apparatus 35, 435, 535, 635, 735, 835, 1035, 1135/fuel source 40 that facilitate ignition thereof, as well as maintenance of the heat-generation apparatus 35, 435, 535, 635, 735, 835, 1035, 1135/fuel source 40 in an ignited condition, to provide the necessary heat for actuating the aerosol-producing segment or portion of the smoking article. Such configurations may also provide benefits and advantages in addition to facilitating and maintaining ignition of the heat-generation apparatus 35, 435, 535, 635, 735, 835, 1035, 1135/fuel source 40 such as, for example, facilitating more efficient formation and manufacture thereof via an extrusion process, enhance consistency in production, and durability in manufacturing and use of the smoking article. For example, as disclosed herein, increasing an edge length associated with the transition between an end surface of the fluted member and the longitudinally-extending outer periphery, and/or providing acute-angle edges between the sides walls of each groove and the outer periphery of the fluted member, may provide for easier or more ready ignition of the fuel source upon direct exposure to heat or flame which, in turn, may facilitate the fuel member remaining in an ignited condition upon removal of the igniting heat or flame. The particular configurations of the heat-generation apparatus 35, 435, 535, 635, 735, 835, 1035, 1135/fuel source 40 disclosed herein may also be more consistently produced, for example, in an extrusion process, through even and regular spacing of the grooves about the fluted member. In turn, the even and regular spacing of the grooves may provide sufficiently robust thicknesses of the lobes (remaining portions of the fluted member defining the grooves) for facilitating durability in manufacturing and use of the product.

In one aspect, the fluted member 1300 defines between six and ten grooves 1320 equidistantly spaced apart about the fluted member 1300. In one preferred aspect, the fluted member 1300 defines eight grooves 1320 equidistantly spaced apart about the fluted member 1300 (see, e.g., FIGS. 10 and 11). In such aspects, the plurality of grooves may be provided in an even number such that the plurality of grooves includes a plurality of pairs of grooves, wherein the grooves in each pair are diametrically opposed to each other across the fluted member. In this manner, the even spacing and distribution of the grooves may facilitate more even heating/burning of the fluted member (i.e., due to the configuration of the cross-section being substantially regular, even, and symmetrical, more consistency may be obtained in the ignition of and heat generated across the cross-sectional profile).

In some particular embodiments, each groove is at least partially defined by substantially parallel side walls 1350. In preferred aspects, each groove 1320 is at least partially defined by opposing side walls 1350, and each side wall 1350 intersects an outer periphery 1360 of the fluted member 1300 at an acute angle. That is, in particular instances, the intersection between each side wall 1350 and the outer periphery 1360 of the fluted member 1300 defines an angle of between about 65° and about 90°, wherein the angle is no more than 90°. In such instances, the side walls 1350 of the groove 1320 are not necessarily substantially parallel to each other. Accordingly, the acute angle provides a "sharp" or more irregular or discontinuous feature of the fluted member which may be more easily or readily ignited by direct exposure to heat or flame.

In some aspects, each groove 1320 is at least partially defined by opposing side walls 1350, and an intersection between each side wall 1350 and an outer periphery 1360 of the fluted member is radiused 1370. Such radiusing may be beneficial, for example, in instances where the fluted member is formed as an extrusion (see, e.g., the exemplary extrusion die illustrated in FIG. 10), since the radiusing may, for example, prevent undesirable lodging or build-up of material as compared to a "sharp" corner, or a fragile edge in the extruded product that may be prone to damage or production irregularities. In the calculations herein, the radiusing of the groove entrances is excluded for simplification, but could be readily included by one skilled in the art if necessary or desired.

In some instances, the heat-generation segment also may include one or more longitudinal channels formed therethrough. The grooves 1320 and/or channels may provide a desired airflow through the heat-generation segment. With the heat-generation segment being configured with such grooves 1320, each groove 1320 may be defined by adjacent lobes 1380 (i.e., solid portions of the heat-generation segment separating the grooves), wherein, in some aspects, each lobe 1380 has a minimum width substantially equal to a width of the groove 1320. In this manner, a substantial thickness of the portions of the fluted member defining the grooves may be retained that provide for robustness and durability of the product during manufacture and use.

In some aspects, each groove 1320 is at least partially defined by a hemicylindrical end wall 1390 (i.e., a semicircular end wall that extends along the length of the groove). More particularly, the hemicylindrical end wall 1390 may have a constant radius, and the maximum depth 1330 of each groove may disposed at a median of the end wall 1390 thereof (i.e., the maximum depth of the groove is at the center point of the semicircular end wall and/or half way between the side walls of the groove), and wherein each groove 1320 is further defined by the side walls 1350 extending from opposing ends of the hemicylindrical end wall 1390. In being so configured, the grooves 1320 in the heat-generation segment may be configured to at least double a surface area of the fluted member 1300, exclusive of the surface areas of the first and second ends thereof, over a surface area defined by an outer periphery of the fluted member without the grooves. That is, the grooves may be configured to at least double the surface area of the outer periphery of the fluted member as compared to a cylinder of the same outer diameter, exclusive of the surface areas of the first and second ends thereof.

For example, the surface area of a right cylinder (excluding the opposing end surfaces) can be defined as $2\pi Rh$, where R is the radius of the cylinder and h is the length of the cylinder. The surface area lost by forming the grooves in the cylinder is nSh, where n is the number of grooves, and S is the arc length of the portion of the cylinder surface removed by formation of each groove. Further, $S=2R \sin^{-1}(c/2R)$, where c is the chord length corresponding to the arc length S. The surface area gained by forming the grooves, however, is the surface area of the semicylindrical end wall of each groove plus the surface area of each side wall of each groove. More particularly, the surface area gained by forming the grooves is $n*h(\pi r+2\ L)$, where r is the radius of the hemicylindrical end wall, and L is the depth of the side wall up to the intersection thereof with the hemicylindrical end wall.

As such, with the example shown in FIG. 13, the total surface area of a cylinder of radius R is $2\pi(2.159\ \text{mm})*h=13.565\ h\ \text{mm}^2$. The surface area of the cylinder lost by forming 8 grooves is $8*h*(2*2.159\ \text{mm})\sin^{-1}(0.559\ \text{mm}/(2*2.159\ \text{mm}))=4.485\ h\ \text{mm}^2$. However, the surface area gained by forming the 8 grooves is $8*h*((a*0.279\ \text{mm})+(2*0.7625\ \text{mm}))=19.212\ h\ \text{mm}^2$. As such, the net gain in surface area in this exemplary embodiment is $19.212\ h\ \text{mm}^2-4.485\ h\ \text{mm}^2=14.727\ h\ \text{mm}^2$. Therefore, the net gain in surface area of the fluted member as compared to a cylinder of the same outer diameter (excluding the opposing end surfaces) is $((13.565\ h\ \text{mm}^2+14.727\ h\ \text{mm}^2)/13.565\ h\ \text{mm}^2)=209\%$.

In regard to the surface area of at least the end surface of the fluted member disposed about the lighting end 14, the surface area of a circular end of a cylinder is defined as $\pi R^2=\pi*(2.159\ \text{mm})\ 2=14.644\ \text{mm}^2$. The 8 grooves causes the loss of the following surface area of that end surface: $8*((\pi r^2/2)+2Lr+((R^2/2)*(S/R-\sin(S/R))))=8*((n(0.279\ \text{mm})^2/2)+2(0.7625\ \text{mm})(0.279\ \text{mm})+(((2.159\ \text{mm})^2/2)*((0.561\ \text{mm})/(2.159\ \text{mm})-\sin((0.561\ \text{mm})/(2.159\ \text{mm})))))=8*(0.122\ \text{mm}^2+0.425\ \text{mm}^2+0.007\ \text{mm}^2)=4.432\ \text{mm}^2$. Therefore, the net loss in surface area of one end surface of the fluted member, as compared to a circular end of the same outer diameter, is $(4.432\ \text{mm}^2/14.644\ \text{mm}^2)=30\%$ (i.e., the surface area of the one end of the fluted member with 8 grooves has 70% of the surface area of a circular end of a cylinder having the same outer diameter).

From another perspective, the inclusion of the grooves to form the fluted member increases the length of the "edge" formed between the first end of the fluted member and the longitudinal surface of the fluted member, over the edge length of the fluted member without the grooves. For example, the edge length of the fluted member without the grooves is essentially the circumference of the first end (circular), namely $2\pi R=2\pi(2.159\ \text{mm})=13.565\ \text{mm}$. In the provided example, each groove reduces the edge length of the circular configuration by S=0.561 mm, for a total for 8 grooves of 4.485 mm (reduction in edge length). However, each groove, configured as disclosed herein, subsequently adds $8*(\pi r+2\ L)=8*((\pi*0.279\ \text{mm})+(2*0.7625\ \text{mm}))=19.212\ \text{mm}$. As such, the net gain in edge length in this exemplary embodiment is 19.212 mm−4.485 mm=14.727 mm. Therefore, the net gain in edge length of the fluted member, as compared to the edge length of the fluted member without the grooves (i.e., a circular first end with the same outer diameter), is $((13.565\ \text{mm}+14.727\ \text{mm})/13.565\ \text{mm})=209\%$.

In light of possible interrelationships between aspects of the present disclosure in providing the noted benefits and advantages associated therewith, the present disclosure thus particularly and explicitly includes, without limitation, embodiments representing various combinations of the disclosed aspects. Thus, the present disclosure includes any combination of two, three, four, or more features or elements set forth in this disclosure, regardless of whether such features or elements are expressly combined or otherwise recited in a specific embodiment description herein. This disclosure is intended to be read holistically such that any separable features or elements of the disclosure, in any of its aspects and embodiments, should be viewed as intended, namely to be combinable, unless the context of the disclosure clearly dictates otherwise.

In other embodiments, a tobacco pellet substrate or an extruded or other monolithic substrate may be used in place of the substrates discussed herein with reference, for example, to FIG. 1. Various other filter designs may be used including perforated filters made of non-cellular acetate materials known in the art, as well as other filter configurations now known or forthcoming, all within the scope of the present disclosure. The other portions of cigarettes made with tobacco pellet substrates or extruded or other monolithic substrates may also be modified in accordance with the state of the art, and still be practiced within the scope of the present disclosure.

Aerosols that are produced by cigarettes of the present disclosure are those that comprise air-containing components such as vapors, gases, suspended particulates, and the like. Aerosol components can be generated from burning tobacco of some form (and optionally other components that are burned to generate heat); by thermally decomposing tobacco caused by heating tobacco and charring tobacco (or otherwise causing tobacco to undergo some form of smolder); and by vaporizing aerosol-forming agent. As such, the aerosol can contain volatilized components, combustion products (e.g., carbon dioxide and water), incomplete combustion products, and products of pyrolysis.

Aerosol components may also be generated by the action of heat from burning tobacco of some form (and optionally other components that are burned to generate heat), upon substances that are located in a heat exchange relationship with tobacco material that is burned and other components that are burned. Aerosol components may also be generated by the aerosol-generation system as a result of the action of the heat generation segment upon an aerosol-generating segment. In some embodiments, components of the aerosol-generating segment have an overall composition, and are positioned within the smoking article, such that those components will have a tendency not to undergo a significant degree of thermal decomposition (e.g., as a result of combustion, smoldering or pyrolysis) during conditions of normal use.

Many modifications and other aspects of the disclosures set forth herein will come to mind to one skilled in the art to which these disclosures pertain having the benefit of the teachings presented in the foregoing descriptions and the associated drawings. For example, those of skill in the art will appreciate that embodiments not expressly illustrated herein may be practiced within the scope of the present disclosure, including that features described herein for different embodiments may be combined with each other and/or with currently-known or future-developed technologies while remaining within the scope of the claims presented here. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. An elongate smoking article having a first end and an opposed second end, said smoking article comprising:

a heat generation member in contact with a tobacco portion arranged toward the first end;

a perforated paper wrapping material associated with the tobacco portion and the heat generation member; and a first filter material engaged with the paper wrapping material and extending longitudinally outward of the heat generation member at the first end.

2. The smoking article according to claim 1, wherein the first filter material comprises a cellulose acetate material or a non-cellular acetate material.

3. The smoking article according to claim 1, comprising a paper material engaged with the first filter material.

4. The smoking article according to claim 1, wherein the perforated paper wrapping material comprises a plurality of perforations arranged toward a mouth end portion disposed at the second end of the elongate smoking article.

5. The smoking article according to claim 1, wherein the heat generation member is in a heat exchange relationship with a tobacco portion arranged toward the first end of the elongate smoking article.

6. The smoking article according to claim 5, wherein the tobacco portion comprises a sheet of tobacco material.

7. The smoking article according to claim 5, comprising a filter portion arranged between the tobacco portion and the second end, the filter portion including a second filter material.

8. The smoking article according to claim 7, wherein the second filter material comprises a cellulose acetate material.

9. The smoking article according to claim 7, comprising an outer wrapping material circumscribing at least the filter portion.

10. The smoking article according to claim 1, wherein the perforated paper wrapping material comprises a cellulose material.

* * * * *